US008337277B2

(12) United States Patent
Shiro et al.

(10) Patent No.: US 8,337,277 B2
(45) Date of Patent: Dec. 25, 2012

(54) POLISHING PAD AND POLISHING APPARATUS

(75) Inventors: Kuniyasu Shiro, Konan (JP); Tomoyuki Honda, Kyoto (JP); Miyuki Hanamoto, Kyoto (JP)

(73) Assignee: Toray Industries, Inc. (JP)

( * ) Notice: Subject to any disclaimer, the term of this patent is extended or adjusted under 35 U.S.C. 154(b) by 942 days.

(21) Appl. No.: 12/162,492

(22) PCT Filed: Jan. 29, 2007

(86) PCT No.: PCT/JP2007/051345

§ 371 (c)(1),
(2), (4) Date: Sep. 2, 2008

(87) PCT Pub. No.: WO2007/091439

PCT Pub. Date: Aug. 16, 2007

(65) Prior Publication Data

US 2009/0042480 A1 Feb. 12, 2009

(30) Foreign Application Priority Data

Feb. 6, 2006 (JP) ..... 2006-027939
Nov. 14, 2006 (JP) ..... 2006-307555

(51) Int. Cl.
*B24B 49/00* (2012.01)

(52) U.S. Cl. ..... 451/6; 451/534

(58) Field of Classification Search ..... 451/6, 41, 451/527, 533, 538, 539, 534
See application file for complete search history.

(56) References Cited

U.S. PATENT DOCUMENTS

| | | | | |
|---|---|---|---|---|
| 5,605,760 | A | 2/1997 | Roberts | |
| 5,893,796 | A | 4/1999 | Birang et al. | |
| 6,358,130 | B1 * | 3/2002 | Freeman et al. | 451/285 |
| 6,362,107 | B1 * | 3/2002 | Shiro et al. | 438/692 |
| 2005/0032464 | A1 * | 2/2005 | Swisher et al. | 451/41 |
| 2005/0148183 | A1 * | 7/2005 | Shiro et al. | 438/692 |
| 2007/0190911 | A1 * | 8/2007 | Shibuki | 451/41 |

FOREIGN PATENT DOCUMENTS

| | | | |
|---|---|---|---|
| JP | 09-007985 | A | 1/1997 |
| JP | 09-036072 | A | 2/1997 |

(Continued)

*Primary Examiner* — Maurina Rachuba
(74) *Attorney, Agent, or Firm* — DLA Piper LLP (US)

(57) ABSTRACT

A polishing pad forms a planar surface on glass, semiconductors, dielectric material/metal composites and integrated circuits, as well as a polishing apparatus where it is difficult for the surface of the substrate to be scratched, the state of polishing can be accurately measured optically during polishing, and whether or not the entire surface of the workpiece is uniformly polished can be measured. The polishing pad includes a through hole that connects the polishing surface and the rear surface in such a location as to pass through the center of the wafer during polishing, the end of the through hole closer to the center of the polishing pad is at a distance of no less than 35% of the radius from the center of the polishing pad, the length of the through hole in the direction of the center of the polishing pad is the same as or shorter than the length in the direction perpendicular to the direction of the center of the polishing pad, the length of the through hole in the direction of the center of the polishing pad is no more than 10% of the radius, and the length of the through hole in the direction perpendicular to the direction of the center of the polishing pad is no more than 12.5% of the radius.

8 Claims, 3 Drawing Sheets a(≦r × 12.5%):24mm(r × 9.4%)
b(≦a):12mm(r × 4.7%)
c:124mm
d:2mm
e(r × 2):508mm ϕ
f(≧r × 35%): 118mm(r × 46.5%)
O:the center of the polishing pad
r(radius):254mm
X(the direction of the center of the polishing pad
Y(the direction perpendicular to the direction of the center of the polishing pad

FOREIGN PATENT DOCUMENTS

| | | | |
|---|---|---|---|
| JP | 11-512977 | T | 11/1999 |
| JP | 2000-254860 | A | 9/2000 |
| JP | 2003-300151 | A | 10/2003 |
| JP | 2004-260156 | | 9/2004 |
| JP | 2006-021290 | | 1/2006 |
| JP | 2006-239833 | | 9/2006 |

* cited by examiner a(≦r × 12.5%):24mm(r × 9.4%)
b(≦a):12mm(r × 4.7%)
c:124mm
d:2mm
e(r × 2):508mm ϕ
f(≧r × 35%): 118mm(r × 46.5%)
O:the center of the polishing pad
r(radius):254mm
X(the direction of the center of the polishing pad
Y(the direction perpendicular to the direction of the center of the polishing pad a(≦r × 12.5%):24mm(r × 9.4%)
b(≦a):12mm(r × 4.7%)
c:124mm
d:2mm
e (r × 2):508mm $\phi$
f(≧r × 35%): 118mm(r × 46.5%)
O:the center of the polishing pad
r(radius):254mm
X(the direction of the center of the polishing pad
Y(the direction perpendicular to the direction of the center of the polishing pad

POLISHING PAD AND POLISHING APPARATUS

RELATED APPLICATIONS

This is a §371 of International Application No. PCT/JP2007/051345, with an international filing date of Jan. 29, 2007 (WO 2007/091439 A1, published Aug. 16, 2007), which is based on Japanese Patent Application Nos. 2006-027939, filed Feb. 6, 2006, and 2006-307555, filed Nov. 14, 2006.

TECHNICAL FIELD

This disclosure relates; to a polishing pad and a polishing apparatus which are used to form a planar surface in semiconductors, dielectric material/metal composites and integrated circuits.

BACKGROUND

As the density of semiconductor devices increases, the importance of the technologies for forming multilayer wires, interlayer insulating films which accompany and electrodes, such as plugs and damascene electrodes, has been increasing. Together with this, the importance of the flattening process for these interlayer insulating films and metal films of the electrodes has been increasing and a polishing technology, which is referred to as CMP (chemical mechanical polishing), has been spreading as an efficient technology for this flattening process.

As for the polishing apparatus using this CMP technology, an apparatus for measuring the polished state by irradiating the polished surface of a substrate, such as a wafer, with a laser beam or visible light from the rear surface of the polishing pad (on the platen side) while polishing the substrate, as shown in FIG. 1, has been attracting attention as being technologically important (see Japanese Unexamined Patent Publication H9 (1997)-7985).

As a polishing pad for detecting the final point which is used in this polishing apparatus, a polishing pad which is useful for polishing wafers on which integrated circuits are mounted and at least a portion of which is made of a hard uniform resin sheet having no essential performance of absorption or transportation of slurry particles where a light beam having a wavelength in a range from 190 nanometers to 3500 nanometers transmits through this resin sheet is introduced (see Japanese Translation of International Unexamined Patent Publication H11 (1999)-512977).

A typical example of such a polishing pad is IC-1000, made by Rohm and Haas Company, and the transmittance of light of the polishing layer made of a foam structure containing micro-balloons (micro-capsules) is insufficient and, therefore, this polishing pad has a polishing layer and a cushion layer which is layered on the above described polishing layer via a double-sided adhesive tape or the like, and an opening which penetrates through all of the above described polishing layer, double-sided adhesive tape and cushion layer is created in a predetermined location of the above described polishing pad, and a Window member made of a thermosetting hard, uniform resin which is solid and transparent is fit into the above described opening from the polishing surface side. This is a structure as shown in FIG. 2.

In the polishing pad having such a transparent, hard, uniform resin as a window member, however, the window member makes contact with the surface of the substrate having a surface to be polished and, therefore, there are problems where the surface of the substrate is easily scratched, the slurry leaks due to the peeling of the window member, and the detection of the final point fails due to the protrusion of the window member in the upward direction from the polishing surface caused by the expansion of air surrounded by the window member and the platen when the temperature rises while polishing. In addition, there is a problem where a manufacturing process becomes complicated due to the difference in the form of the openings created in the polishing layer and the cushion layer. Furthermore, there is a problem with the process where the molding cycle time becomes long in the manufacture of the thermosetting hard, uniform resin.

Meanwhile, methods for polishing a wafer according to which through holes are provided in the polishing pad and the polished state is determined by viewing the state of reflection of light from the polished surface of a wafer are known (see Japanese Unexamined Patent Publication 2000-254860). As for the two types of through holes introduced herein, however, an end of one through hole is close to the center of the polishing pad and, therefore, slurry supplied from the center of the polishing pad goes into the through hole and stays there, and a problem arises where a sufficient amount of light does not pass through while the length of another through hole in the direction perpendicular to the direction of the center of the pad is too long for the wafer and, therefore, a problem arises that the workpiece cannot be polished uniformly.

In view of that background, it could be helpful to provide a polishing pad and a polishing apparatus where the polishing pad is used to form a planar surface on glass, semiconductors, dielectric material/metal composites and integrated circuits, it is difficult for the surface of the substrate to be scratched, the polished state can be appropriately measured optically during polishing, and whether or not the entire surface of the workpiece can be polished uniformly can be measured.

SUMMARY

We provide polishing pads characterized in that a through hole connecting the surface to be polished and the rear surface is provided, the end of the through hole close to the center of the polishing pad is at a distance of 35% or more of the radius from the center of the polishing pad, the length of the through hole in the direction of the center of the polishing pad is the same as or shorter than the length in the direction perpendicular to the direction of the center of the polishing pad, the length of the through hole in the direction of the center of the polishing pad is 10% or less of the radius, and the length in the direction perpendicular to the direction of the center of the polishing pad is 12.5% or less of the radius.

We thus provide a semiconductor device in accordance with a simplified method where the surface of the workpiece is seldom scratched, the polished state can be appropriately measured optically during polishing, and whether or not the entire surface of the workpiece can be polished uniformly can be measured when forming a planar surface on glass, semiconductors, dielectric material/metal composites and integrated circuits.

EXPLANATION OF SYMBOLS

Figure 1:
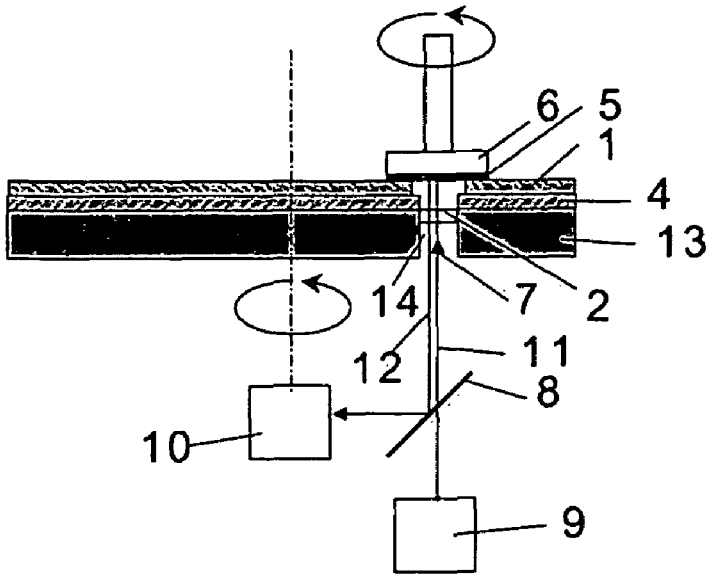
FIG. 1 is a schematic diagram illustrating a principle for optically measuring the polished state using an example of a polishing apparatus.
Figure 2:
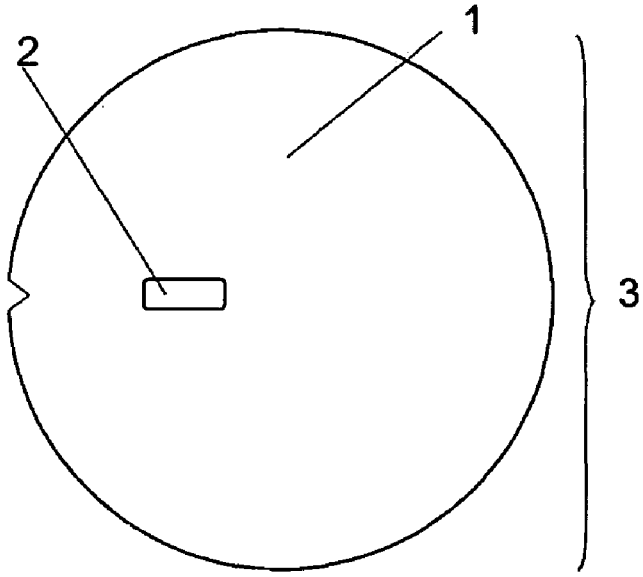
FIG. 2 is a plan diagram showing a conventional polishing pad for detecting the final point having a window member.

| | |
|---|---|
| 1 | polishing layer |
| 2 | light transmitting material |
| 3 | polishing pad for detecting final point |
| 4 | cushion layer |
| 5 | workpiece (wafer) |
| 6 | polishing head |
| 7 | laser or white light |
| 8 | beam splitter |
| 9 | light source |
| 10 | photodetector |
| 11 | incident light |
| 12 | reflected light |
| 13 | platen |
| 14 | hole |
| 15 | through hole |
| 16 | rear surface tape |
| 17 | middle tape |
| 18 | path |

DETAILED DESCRIPTION

We discovered a polishing pad where it is difficult for the surface of the workpiece to be scratched, the polished state can be appropriately measured optically during polishing, and whether or not the entire surface of the workpiece can be polished uniformly can be measured, and as a result, we provide a polishing pad where a through hole connecting the surface to be polished and the rear surface is provided, the end of the through hole close to the center of the polishing pad is at a distance of 35% or more of the radius from the center of the polishing pad, the length of the through hole in the direction of the center of the polishing pad is the same as or shorter than the length in the direction perpendicular to the direction of the center of the polishing pad, the length of the through hole in the direction of the center of the polishing pad is 10% or less of the radius, and the length in the direction perpendicular to the direction of the center of the polishing pad is 12.5% or less of the radius and, thus, it was found that all of these problems can be solved.

It is preferable for the polishing pad to have a polishing layer and a cushion layer. As the polishing layer that forms the polishing pad, a structure where the micro-rubber A hardness is 70 degrees or higher having isolated bubbles forms a planar surface on semiconductors, dielectric material/metal composites and integrated circuits and, therefore, is preferable. Though there are no particular limitations in terms of the material for forming the structure, polyethylene, polypropylene, polyester, polyurethane, polyurea, polyamide, polyvinyl chloride, polyacetal, polycarbonate, polymethyl methacrylate, polytetrafluoroethylene, epoxy resins, ABS resins, AS resins, phenol resins, melamine resins, neoprene rubbers, butadiene rubbers, styrene butadiene rubbers, ethylene propylene rubbers, silicon rubbers, fluorine rubbers and resins having one of these as the main component can be cited. From among these resins, a material having polyurethane as the main component is preferable, because the diameter of isolated bubbles can be controlled relatively easily.

Polyurethane means a polymer synthesized by inducing addition polymerization reaction or a polymerization reaction using polyisocyanate. A compound with which polyisocyanate reacts is a compound containing active hydrogen, that is to say, a compound that contains two or more polyhydroxy groups or an amino group. As the polyisocyanate, tolylene diisocyanate, diphenylmethane diisocyanate, naphthalene diisocyanate, hexamethylene diisocyanate, isophorone diisocyanate and the like can be cited, but the disclosure is not limited to these. Polyol is typically used as a compound containing a polyhydroxy group, and polyether polyol, polytetramethylene ether glycol, epoxy resin modified polyol, polyester polyol, acryl polyol, polybutadiene polyol, silicone polyol and the like can be cited. It is preferable to combine polyisocyanate and polyol and a catalyst, a foaming agent and a foam stabilizer in optimal amounts on the basis of the hardness, the diameter of the foam and the expansion ratio.

As the method for forming isolated bubbles in the polyurethane, a chemical foaming method for mixing various types of foaming agents into the resin at the time of manufacture of polyurethane is generally used, but a method for foaming, a resin by mechanically stirring and after that curing the resin is also appropriate for use.

It is preferable for the average diameter of the bubbles in the isolated bubbles to be 30 μm or greater and 150 μm or less, to reduce scratching and make the semiconductor substrate locally flat. It is more preferable for the average diameter of the bubbles to be 140 μm or less, and it is most preferable for it to be 130 μm or less. In the case where the average diameter of the bubbles is less than 30 μm, there is more scratching, which is not preferable. In addition, in the case where the average diameter of the bubbles exceeds 150 μm, the local flatness of the semiconductor substrates becomes poor, which is not preferable. The average diameter of the bubbles is a value gained by observing the cross section of a sample through an SEM at a magnification of 200 times, measuring the diameter of the bubbles in the recorded SEM photograph with an image processing apparatus and calculating the average value.

Pads having isolated bubbles in a polymer gained by polymerizing polyurethane and a vinyl compound are preferable. Polyurethane becomes fragile as the hardness increases, and though the tenacity and hardness can be increased in polymers made of a vinyl compound, it is difficult to gain a uniform polishing pad having isolated bubbles. When the polishing pad contains a polymer polymerized from polyurethane and a vinyl compound, isolated bubbles are included and a high tenacity and hardness can be gained.

The vinyl compound is a compound having double bonded carbon which can be polymerized. Concretely, methyl acrylate, methyl methacrylate, ethyl acrylate, ethyl methacrylate, n-butyl acrylate, n-butyl methacrylate, 2-ethylhexyl methacrylate, isodecyl methacrylate, n-lauryl methacrylate, 2-hydroxyethyl methacrylate, 2-hydroxypropyl methacrylate, 2-hydroxybutyl methacrylate, dimethylaminoethyl methacrylate, diethylaminoethyl methacrylate, glycidyl methacrylate, ethylene glycol dimethacrylate, acrylic acid, methacrylic acid, fumaric acid, dimethyl fumarate, diethyl fumarate, dipropyl fumarate, maleate, dimethyl maleate, diethyl maleate, dipropyl maleate, phenylmaleimide, cyclohexylmaleimide, isopropylmaleimide, acrylonitrile, acrylamide, vinyl chloride, vinylidene chloride, styrene, a-methyl styrene, divinylbenzene, ethylene glycol dimethacrylate, diethylene glycol dimethacrylate, and the like can be cited. These monomers can be used alone, or two or more can be mixed for use.

From among the above described vinyl compounds, $CH_2{=}CR^1COOR^2$ ($R^1$: methyl group or ethyl group, $R^2$: methyl group, ethyl group, propyl group or butyl group) is preferable. From among these, methyl methacrylate, ethyl methacrylate, n-butyl methacrylate and isobutyl methacrylate are preferable, because they can make formation of isolated bubbles in polyurethane easy, impregnation with monomers is preferable, curing through polymerization is easy, and a foaming structure containing a polymer polymerized from polyurethane and a vinyl compound cured through polymerization has a high hardness and flattening properties are preferable.

As the polymerization initiator for the vinyl compound, radical initiators, such as azobisisobutylonitrile, azobis(2,4-dimethylvaleronitrile), azobis(cyclohexane carbonitrile), benzoyl peroxide, lauroyl peroxide and isopropyl peroxydicarbonate, can be used. In addition, oxidation and reduction based polymerization initiators, for example a combination of a peroxide and an amine, can be used. These polymerization initiators can be used alone, or two or more can be mixed for use.

As the method for impregnating polyurethane with a vinyl compound, a method for dipping and impregnating polyurethane with a monomer in a container can be cited. It is preferable to carry out such a process as heat application, pressure application, pressure reduction, stirring, vibration or ultrasonic vibration, to increase the rate of impregnation.

The amount of vinyl compound with which the polyurethane is impregnated should be determined on the basis of the type of monomer and polyurethane used, and the properties of the manufactured polishing pad, and not indiscriminately, but in the case where a vinyl compound is used, it is preferable for the weight ratio of the polymer gained from a vinyl compound in the polymerized and cured foaming structure to the polyurethane content to be 30/70 to 80/20. In the case where the weight, ratio of the polymer content gained from a vinyl compound is less than 30/70, the hardness of the polishing pad is sometimes low, which is not preferable. In addition, in the case where the content ratio exceeds 80/20, the elasticity of the polishing layer may sometimes be affected, which is not preferable.

The polymer content and the polyurethane content gained from the vinyl compound in the polymerized and hardened polyurethane can be measured in accordance with a thermal decomposition gas chromatography/mass analyzing technique. In terms of the apparatus used for this technique, a double shot pyrolizer "PY-2010D" (made by Frontier Laboratories Ltd.) can be cited as a thermal decomposition apparatus, and "TRIO-1" (made by VG Co., Ltd.) can be cited as a gas chromatograph mass analyzing apparatus.

Polyurethane and a vinyl polymer being contained integrally means that the phase of polyurethane and the phase of the polymer polymerized from a vinyl compound are not contained in a separated state and, quantitatively speaking, the infrared spectrum gained by observing the polishing pad with a microscopic infrared spectrometer having a 50 μm spot has the infrared absorption peak of polyurethane and the infrared absorption peak of a polymer polymerized from a vinyl compound and, thus, the infrared spectrum is approximately the same in various places. As the microscopic infrared spectrometer used here, IRμs, made by SPECTRATECH Inc., can be cited.

Various types of additives, such as a polishing agent, a charge preventing agent, a lubricant, a stabilizer or a dye, may be added, to improve the properties of the manufactured polishing pad.

The micro-rubber A hardness of the polishing layer is a value found using a micro-rubber hardness meter MD-1, made by Kobunshi Keiki Co., Ltd. Micro-rubber A hardness meter MD-1 makes measurement of the hardness of thin or small objects which are difficult to measure using a conventional hardness meter possible, and is designed and manufactured as a scaled-down model of approximately ⅕ of a type A spring type rubber hardness meter (durometer) and, therefore, the measured value, which coincides with the hardness measured using a type. A spring type hardness meter, can be gained. Conventional polishing pads have a polishing layer or a hard layer of which the thickness is less than 5 mm, and thus cannot be measured using a type A spring type rubber hardness meter, and therefore measured using the above described micro-rubber MD-1.

It is preferable for the polishing layer to be 70 degrees or higher in the micro-rubber A hardness, and it is more preferable for it to be 80 degrees or higher. In the case where the micro-rubber A hardness is less than 70 degrees, the flatness of the semiconductor substrate sometimes becomes poor in localized areas, which is not preferable.

The density of the polishing layer has a value which can be measured with water as a medium, using a Harvard type pycnometer (JISR-3503 standard).

It is preferable for the density of the polishing layer to be within a range of 0.3 g/cm$^3$ to 1.1 g/cm$^3$. In the case where the density is less than 0.3 g/cm$^3$, the flatness becomes poor in localized areas and, in some cases, the global step becomes great. In the case where the density exceeds 1.1 g/cm$^3$, the object being polished is easily scratched. More preferably, the density is within a range of 0.6 g/cm$^3$ to 0.9 g/cm$^3$, and most preferably, the density is within a range of 0.65 g/cm$^3$ to 0.85 g/cm$^3$.

The grooves created on the surface of the polishing layer of the polishing pad can have the same form as in conventional polishing pads, for example in slot form, in dimple form, in spiral form or in concentric circles, to prevent a hydroplane phenomenon.

It is preferable for the grooves not to make contact with a through hole in the region inside the concentric circles of the polishing pad which passes through the center point of the through hole. The center point of the through hole is the intersection between a line which divides the angle between two straight lines passing through the two ends of the through hole from the center of the polishing pad into two, and a straight line which connects the two ends of the through hole. In the case where a groove makes contact with a through hole in the region inside the concentric circles of the polishing pad which passes through the center point of the through hole, slurry easily flows into the through hole, making it easy for light to become scattered and, thus, there is a possibility that the final point may not be detected accurately, which is not preferable.

The polishing pad is usually dressed with a conditioner where diamond abrasive grains are electrically deposited on the surface of the polishing layer before or during polishing. As for the dressing method, it is possible to use either pre-polishing ex situ dressing or simultaneous in situ dressing.

It is preferable to layer a cushion layer of which the volume modulus of elasticity is 40 MPa or higher and the tensile modulus of elasticity is 1 MPa or higher and 20 MPa or lower on the polishing layer, to make the uniformity within the plane excellent. The volume modulus of elasticity is gained by measuring the change in volume by applying isotropic pressure to the object to be measured, of which the volume has been measured in advance. The formula is: volume modulus of elasticity=applied pressure/(change in volume/original volume).

The volume modulus of elasticity was measured as follows. A test piece and water of 23° C. were put in a measurement cell made of stainless steel having an internal volume of approximately 40 mL, and a measuring pipette made of borosilicate glass having a volume of 0.5 mL (minimum scale: 0.005 mL) was installed. A tube made of a polyvinyl chloride resin (inner diameter: 90 mm×2000 mm×thickness: 5 mm) was separately used as a pressure container, and the measurement cell in which the above described test piece was put was put in this, and pressure P was applied using nitrogen, so that the change in volume V1 could be measured. Subsequently, pressure P in Table 1 was applied using nitrogen without putting the sample in the measurement cell, so that the change in volume V0 could be measured. The value gained by dividing pressure P by $\Delta V/Vi=(V\mathbf{1}-V\mathbf{0})/Vi$ was calculated as the volume modulus of elasticity of the above described sample.

The volume modulus of elasticity is the volume modulus of elasticity when pressure of 0.04 MPa to 0.14 MPa is applied to the sample at 23° C.

It is preferable for the volume modulus of elasticity of the cushion layer to be 40 MPa or higher. In the case where the volume modulus of elasticity is lower than 40 MPa, the uniformity within the plane on the surface of the semiconductor substrate is sometimes lost, which is not preferable. Another reason why it is not preferable for the modulus of elasticity to be lower than 40 MPa is that the cushion layer is impregnated with slurry or water which flows into a hole that penetrates through the polishing pad from the front surface to the rear surface and, thus, the cushioning properties sometimes change over time. A more preferable range for the volume modulus of elasticity is 200 MPa or higher.

The tensile modulus of elasticity is defined as tensile modulus of elasticity=((tensile stress when tensile distortion is 0.03)−(tensile stress when tensile distortion is 0.01))/0.02 when a tensile stress is applied to a test piece in dumbbell form, and the tensile stress is measured for the tensile distortion (=change in the tensile length/original length) in a range from 0.01 to 0.03. As the measuring apparatus, Tensilon Multi-Purpose Tester RTM-100, made by Orientec Co., Ltd., can be cited. As for the measuring conditions, the rate of testing is 5 cm/min and the test piece is in dumbbell form with a width of 5 mm, and the length of the sample is 50 mm.

It is preferable for the tensile modulus of elasticity of the cushion layer to be 1 MPa or higher and 20 MPa or lower. In the case where the tensile modulus of elasticity is less than 1 MPa, the uniformity within the plane on the entire surface of the semiconductor substrate is sometimes lost, which is not preferable. In the case where the tensile modulus of elasticity exceeds 20 MPa, the uniformity within the plane on the surface of the semiconductor substrate is sometimes lost, which is not preferable. A more preferable range for the tensile modulus of elasticity is 1.2 MPa or higher and 10 MPa or lower.

It is preferable for the percentage of water absorption in the cushion layer to be 5% or less. In the case where the percentage of water absorption exceeds 5%, water used during polishing is absorbed by the cushion layer, the portion around the periphery of the through hole in the polishing pad swells and the edge of the through hole becomes higher than other portions on the surface of the polishing layer and, thus, uniform polishing is hindered and the object being polished becomes scratched, which is not preferable.

As the cushion layer, unfoamed elastomers, such as natural rubber, nitrile rubber, neoprene rubber, polybutadiene rubber, thermosetting polyurethane rubber, thermoplastic polyurethane rubber or silicon rubber, can be cited, but there are no limitations to these. It is preferable for the thickness of the cushion layer to be in a range from 0.3 mm to 2 mm. In the case where the thickness is less than 0.5 mm, the uniformity within the plane on the entire surface of the semiconductor substrate is sometimes lost, which is not preferable. In the case where the thickness exceeds 2 mm, the flatness is sometimes lost in localized areas, which is not preferable. A more preferable range for the thickness is 0.5 mm or more and 2 mm or less. The most preferable range is 0.75 mm or more and 1.75 mm or less.

The polishing pad is provided with a through hole which penetrates through the polishing pad from the polishing surface to the rear surface.

It is necessary for the end of the through hole closer to the center of the polishing pad to be at a distance of 35% or more of the radius from the center of the polishing pad. In the case where the end of the through hole closer to the center of the polishing pad is at a distance of less than 35% of the radius from the center of the polishing pad, the slurry supplied in the center of the platen easily flows into the through hole and a large amount of slurry easily stays in the through hole and, thus, the signal for optically detecting the final point becomes small, due to scattering of the slurry, which is not preferable. A more preferable distance is 38% or more of the radius.

In addition, when the end of the through hole closer to the center of the polishing pad is at a distance of 35% or more of the radius from the center of the polishing pad, the through hole, which penetrates from the polishing surface to the rear surface, is created in such a location as to pass through the center of the wafer during polishing, without the polishing agent coming close to the center of the polishing pad and, thus, it is possible to detect the final point where the entire surface of the wafer is polished uniformly.

The through hole in the polishing pad in a cross section may be in various forms, such as square, ellipsis, circle or rectangle, and it is preferable for the length of the polishing pad in the direction of the center to be the same as or shorter than the length of the polishing pad in a direction perpendicular to the direction of the center. In the case where the length of the polishing pad in the direction of the center is greater than the length of the polishing pad in a direction perpendicular to the direction of the center, the wafer cannot be polished uniformly, and the uniformity within the plane is lost, which is not preferable.

The size of the through hole in the polishing pad should allow the state of polishing to be optically measurable during polishing and, thus, it is necessary for the length of the through hole in the direction of the center of the polishing pad to be 10% or less of the radius. In the case where the length exceeds 10% of the radius, a large amount of slurry enters into the through hole, and the signal for optically detecting the final point becomes small, due to scattering by the slurry that enters the through hole, which is not preferable. In addition, it is preferable for the length of the through hole in the direction of the center of the polishing pad to be 5 mm or more or 20 mm or less. In the case where the length is less than 5 mm, the signal for optically detecting the final point becomes small, which is not preferable.

It is necessary for the length of the through hole in a direction perpendicular to the direction of the polishing pad to be 12.5% or less of the radius. In the case where the length exceeds 12.5% of the radius, the wafer, which is the material being polished, cannot be uniformly polished, which is not preferable. In addition, it is preferable for the length of the through hole in a direction perpendicular to the direction of the center of the polishing pad to be 5 mm or more and 25 mm or less. In the case where the length is less than 5 mm, the signal for optically detecting the final point becomes small, which is not preferable.

Figure 3:
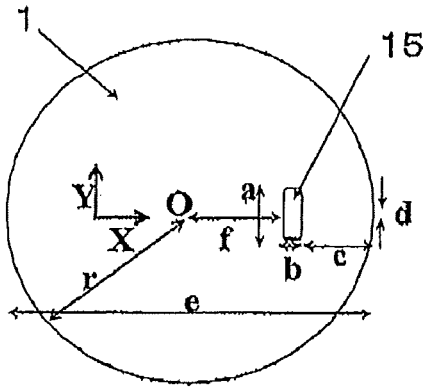
FIG. 3 is a plan diagram showing a polishing pad where a through hole is provided.
Figure 5:
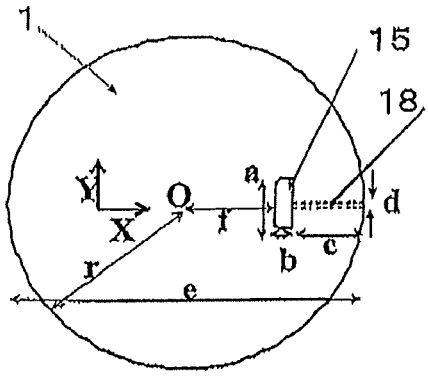
FIG. 5 is a plan diagram showing a polishing pad where a through hole and a path for connecting the side and the through hole are provided.

"Connecting" means that openings are connected. FIGS. 3 and 5 show a through hole 15 which connects the polishing surface and the rear surface of the polishing layer 1.

As the method for creating a through hole for connecting the polishing surface and the rear surface, a punch-out method using a predetermined die and a boring method using a blade with an NC rooter can be cited.

Figure 4:
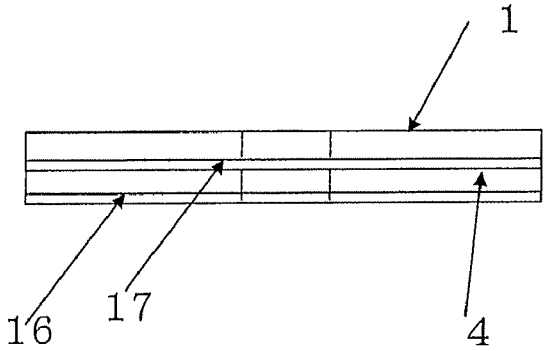
FIG. 4 is a cross sectional diagram showing a polishing pad where a through hole is provided.
Figure 6:
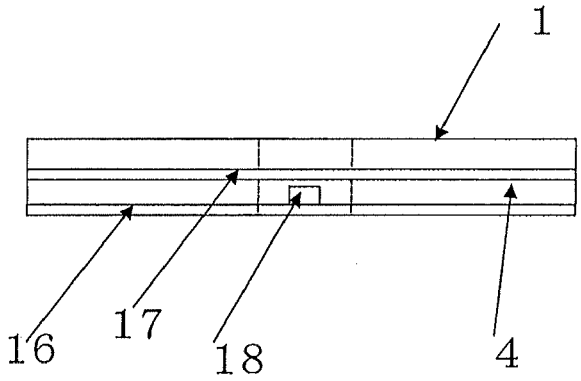
FIG. 6 is a cross sectional diagram showing a polishing pad where a through hole and a path for connecting the side and the through hole are provided.

In the case where the cushion layer is 1.5 mm or more and 2 mm or less, scrap from polishing easily remains and, therefore, it is preferable to provide a path for connecting the through hole, which connects the polishing surface and the rear surface, and the side of the polishing pad, to reduce scratching. FIGS. 3 and 4 show a through hole 14 which connects the polishing surface and the rear surface. FIGS. 5 and 6 show a path 17 for connecting the through hole, which connects the polishing surface and the rear surface, and the side of the polishing pad. It is preferable for the distance between the above described path and the above described rear surface to be ½ or less of the thickness of the polishing pad on the surface through which the through hole for connecting the polishing surface and the path for connecting to the side of the polishing pad make contact.

The Surface through which the above described through hole and the above described path make contact is in such a location that the above described through hole and the above described path cross, and the distance between the above described path and the above described rear surface is the distance between the rear surface and a point on the path which crosses the rear surface and closest to the rear surface. In the case where the distance between the above described path and the above described rear surface on the surface through which the above described through hole and the above described path make contact exceeds ½ of the thickness of the polishing pad, slurry and scrap from polishing which stay in the through hole cannot be sufficiently discharged, and this sometimes causes the wafer to be scratched, which is not preferable.

The path, which connects the through hole, which connects the polishing surface and the rear surface, and the side of the polishing pad may have any of various forms in a cross section, such as square, ellipsis, circle or rectangle, but square or rectangle is preferable, because it is difficult for it to affect the change in the form of the polishing pad on the surface. It is preferable for the length of the path in the direction of the thickness in a cross section to be ½ or less of the thickness of the polishing pad, because it is difficult for it to affect the change in form of the polishing pad on the surface.

It is preferable for the size of the path which connects the through hole, which connects the polishing surface and the rear surface, and the side of the cross section of the polishing pad to be 0.05% or more and 10% or less of the size of the through hole, which connects the polishing surface and the rear surface in a cross section. In the case where the size is less than 0.05%, slurry and scrap from polishing sometimes fail to be sufficiently discharged, which is not preferable. In the case where the size exceeds 10%, this sometimes affects the surface of the polishing pad, making the polishing properties deteriorate, which is not preferable. A more preferable range for the size is 0.1% or more and 5% or less.

As the method for creating a through hole which connects the polishing surface and the rear surface, a punch-out method using a predetermined die and a boring method using a blade with an NC rooter and the like can be cited.

As a method for creating a path which connects the hole, which penetrates through the polishing pad from the front surface to the rear surface, from the side of the polishing pad, the following method can be cited.

In the case of a pad where the polishing layer is a single layer, a method for creating grooves for connecting the through hole and the side of the polishing layer in advance on the rear surface of the polishing layer and pasting a tape on the rear surface so that a polishing pad is gained can be cited.

In the case of a polishing pad made up of at least a polishing layer and a cushion layer, a method for creating a groove which connects the through hole and the side in advance in the cushion layer and pasting a middle tape and a rear surface tape to the cushion layer so that the polishing layer is pasted and then creating a through hole, and a method for pasting a polishing layer, a middle tape, a cushion layer and a rear surface tape together and after that creating a through hole, and then creating a groove for connecting the through hole and the side with an NC rooter or the like in the cushion layer from the rear surface tape side, can be cited.

Next, the polishing apparatus is described.

The polishing apparatus is provided with at least a polishing pad, as described above, a means for supplying slurry into a space between the polishing pad and a workpiece, a means for making the above described polishing pad and a substrate make contact with each other and moving them relative to each other for polishing, and a means for optically measuring the state of polishing through the through hole provided in the above described polishing pad. The means other than the polishing pad can be formed by combining conventional means. Using this apparatus, a load is applied between the above: described polishing pad and the above described substrate in such a state that there is slurry between the polishing pad and the substrate, and the above described substrate and the above described polishing pad are moved relative to each other, so that the workpiece is polished, and it is possible to optically find out the state of polishing of the workpiece by irradiating the above described workpiece with light.

Concretely, an apparatus having the configuration shown in FIG. 1 can be cited as an example. A hole 14 is created in a platen 13, and the through hole in the above described polishing pad is located above the hole 14. A light transmitting material 2 is fit into the hole 14, and thus functions to prevent slurry from leaking, so that slurry drops and makes contact with the beam splitter 8 or the like beneath the platen. The location of the hole is determined so that the workpiece 5, which is held by the polishing head 6, can be viewed for some time while the platen 13 is rotating. The light source 9 is placed beneath the platen 13 and secured in such a location that when the hole approaches the workpiece 5, incident light 11 from the laser or white light 7 that progresses from the light source 9 passes through the hole in the platen 13 and the polishing layer 1 so as to hit the surface of the workpiece 5, which is placed on top of the polishing layer 1. Light 12 reflected form the surface of the workpiece 5 is guided into a photodetector 10 by a beam splitter 8, and the waveform of intense light detected by the light detection portion 10 is analyzed, so that the state of polishing on the surface of the workpiece can be measured.

In the case where there is concern that slurry may leak from the transparent material fitted into the hole in the polishing apparatus, it is preferable to paste a protective film which can cover the entire portion on the surface of the platen before the polishing pad is pasted to the platen. The protective film is a transparent base film having a thickness of 10 μm to 50 μm on which an adhesive layer having a thickness of 10 μm to 30 μm is formed, and it is preferable for the size of the protective film to be two or more times larger than the area of the hole, because slurry can be prevented from making contact with the hole portion.

In the protective film, the adhesive layer portion is coated with a separator film which is larger than the end of the base film, and the separator film is divided in two or more, and a portion of the divided separator film is peeled off, and the exposed adhesive layer is pasted over the whole platen portion, and the remaining separator film is peeled, so that the adhesive layer is pasted and secured to the platen and, thus, there is no wrinkling, and easy pasting becomes possible, which is preferable. As for the dividing method, division in three is preferable, because first the center can be peeled and the exposed adhesive layer pasted to the hole in the platen, and after that the remaining separator films peeled off, so that the adhesive layer is pasted and secured to the platen and, thus, there is no wrinkling and no bubbles, and easy pasting becomes possible. There is less concern of slurry leaking from the transparent material in the hole when the polishing pad is pasted in the portion where the protective film is pasted. It is preferable for the separator film to be larger than the base film by at least 3 mm, because the separator film can be easily peeled off using the portion which extends from the end of the base film.

Using the polishing pad, unevenness in the insulating film and metal wires on a semiconductor wafer can be locally flattened, the global step can be reduced, and dishing can be prevented using a silica based slurry, an aluminum oxide based slurry, a cerium oxide based slurry or the like as the slurry. As concrete examples of the slurry, CAB-O-SPERSE (registered trademark) SC-1 for CMP, made by Cabot Corporation, CAB-O-SPERSE (registered trademark) SC-112 for CMP, SEMI-SPERSE (registered trademark) AM100 for CMP, SEMI-SPERSE (registered trademark) AM100C for CMP, SEMI-SPERSE (registered trademark) 12 for CMP, SEMI-SPERSE (registered trademark) 25 for CMP, SEMI-SPERSE (registered trademark) W2000 for CMP and SEMI-SPERSE (registered trademark) W-A400 for CMP can be cited, but there are no limitations to these.

The objects polished using the polishing pad are the surface of an insulating layer and metal wires formed on a semiconductor wafer, for example, and as insulating layers, interlayer insulating films of metal wires, lower layer insulating films of metal wires and shallow trench isolation used for element isolation can be cited, and as metal wires, aluminum wires, tungsten wires and copper wires having a damascene, dual damascene or plug structure can be cited. In the case where metal wires are made of copper, a barrier metal made of silicon nitride or the like also becomes an object to be polished. Though currently most insulating films are made of silicon oxide, low dielectric constant insulating films have started being used, to solve the problem of time delay. It is possible to accurately measure the state of polishing while polishing in such a state that it is difficult for the object to become scratched using the polishing pad. The polishing pad can be used for polishing magnetic heads, hard discs and sapphire, in addition to semiconductor wafers.

The polishing pad is appropriate for use when forming a planar surface on glass, semiconductors, dielectric material/metal composites and integrated circuits.

EXAMPLES

In the following text, we describe our polishing pads and apparatus in further detail using examples. However, it should be understood that our disclosure is not limited to the examples. Measurement was carried out as follows.

Micro-Rubber A Hardness:

The hardness was measured using a micro-rubber hardness meter "MD-1" made by Kobunshi Keiki Co., Ltd. The configuration of the micro-rubber hardness meter "MD-1" was as follows:

1.1 Sensor (1) Type of load: plate spring in form of beam supported at one end (2) Spring load: 0 point/2.24 gf 100 points/33.85 gf (3) Error in spring load: +/−0.32 gf (4) Size of pressing button: columnar form with diameter of 0.16 mm and height of 0.5 mm (5) Displacement detecting type: warp gauge type (6) Size of pressure applying leg: outer diameter: 4 mm, inner diameter: 1.5 mm 1.2 Sensor Driving Unit (1) Driving system: up-down drive using stepping motor, control of lowering speed using air damper (2) Stroke in up-down movement: 12 mm (3) Speed of lowering: 10 mm/sec to 30 mm/sec (4) Range of height adjustment: 0 mm to 67 mm (distance between sample table and sensor pressure applying surface)

1.3 Sample Stand (1) Size of sample stand: diameter: 80 mm (2) Micromotion mechanism: micromotion using XY table and micrometer head, strokes: 15 mm for both X axis and Y axis (3) Level adjustor: main body legs for adjusting level and round level Bubble diameter measurement: SEM2400 scanning electron microscope made by Hitachi, Ltd. was used to analyze a photograph as observed at a magnification of 200 times by means of an image analyzing apparatus, and the diameter of all of the bubbles in the photograph was thus measured and the average value taken as the average bubble diameter.

Measurement of volume modulus of elasticity: 27 g of an NBR rubber sheet (specific weight: 1.29, initial volume: 21 ml) and water of 23° C. were put in a measurement cell made of stainless steel of which the internal volume was approximately 40 mL, and a measuring pipette made of borosilicate glass (minimum scale: 0.005 mL) with a volume of 0.5 mL was mounted on top of this, as shown in FIG. 5. A separate tube made of a polyvinyl chloride resin (inner diameter: 90 mm×2000 mm, thickness: 5 mm) was used as a pressure container, and the measurement cell in which the above described test piece was put was put on top of the pressure container, to which pressure P in Table 1 was applied using nitrogen, and the change in volume V1 was measured. Subsequently, pressure P in Table 1 was applied using nitrogen, without the sample being put in the measurement cell, and the change in volume V0 was measured for water only. The value gained by dividing pressure P by $\Delta V/Vi=(V1-V0)/Vi$ was calculated as the volume modulus of elasticity of the above described sample.

Polishing apparatus which can optically and accurately measure state of polishing during polishing: Mirra 3400 (registered trademark) or Reflexion (registered trademark) made by Applied Materials, Inc. was used to polish the samples while detecting the final point under the predetermined conditions for polishing. As for the polishing properties, the polishing rate (angstrom/min) of an 8-inch wafer or a 12-inch wafer, excluding the outermost periphery of 3 mm, and the uniformity within the plane, that is, (maximum polishing rate—minimum polishing rate)/average polishing rate×100 (%), were measured.

Inspection for defects: defects of 0.18 μm and greater were measured using SP-1, made by KLA-Tencol Co., Ltd., and a defect inspecting apparatus Complus, made by Applied Materials, Inc.

Measurement of percentage of water absorption: the weight of a test piece of the cushion layer when dry was measured, and this was immersed in water for 24 hours, and after that, the weight of the test piece, which had absorbed water, was measured, and the value was calculated using the formula: (weight of test piece after absorbing water−weight of dry test piece)/weight of dry test piece×100(%).

Example 1

30 weight parts of polypropylene glycol, 40 weight parts of diphenylmethane diisocyanate, 0.5 weight parts of water, 0.3 weight parts of triethylamine, 1.7 weight parts of a silicone foaming agent and 0.09 weight parts of tin octylate were mixed in an RIM molding machine, and the mixture was discharged into a mold for pressure molding and, thus, a foam polyurethane sheet with isolated bubbles having a thickness of 2.6 mm (micro-rubber A hardness: 42, density: 0.76 g/cm$^3$, average bubble diameter of isolated bubbles: 34 μm) was fabricated.

The above described foam polyurethane sheet was immersed in methyl methacrylate to which 0.2 weight parts of azobisisobutylonitrile was added for 60 minutes. Next, the above described foam polyurethane sheet was immersed in a solution of 15 weight parts of polyvinyl alcohol "CP" (made by Nacalai Tesque, Inc.; degree of polymerization: approximately 500), 35 weight parts of ethyl alcohol (special class reagent made by Katayama Chemical Industries Co., Ltd.) and 50 weight parts of water, and after that dried, and thus, the surface layer of the above described foam polyurethane sheet was coated with polyvinyl alcohol. Next, the above described foam polyurethane sheet was sandwiched between two glass plates with a gasket made of vinyl chloride in between on either side, and heated for 6 hours at 65° C. and for three hours at 120° C. so as to be cured through polymerization. The sheet was removed from the glass plates and washed with water, and after that dried in a vacuum at 50° C.

The thus gained hard foam sheet was sliced to a thickness of 2.00 mm and, thus, a polishing layer was fabricated. The methyl methacrylate content in the polishing layer was 66 weight %. In addition, the micro-rubber A hardness of the polishing layer was 98 degrees, the density was 0.81 g/cm3, and the average bubble diameter of the isolated bubbles was 45 μm.

The sheet was layered with thermoplastic polyurethane made by Nihon Matai Co., Ltd. having a micro-rubber A hardness of 65 degrees and a thickness of 1.00 mm (volume modulus of elasticity: 65 MPa, tensile modulus of elasticity: 4 MPa, percentage of water absorption: 0.2%), which functioned as a cushion layer, with an adhesive layer (middle tape) 5782W, made by Sekisui Chemical Co., Ltd., in between and, furthermore, a double-sided tape 5604TDX, made by Sekisui Chemical Co., Ltd., was pasted on the rear surface as a rear surface tape.

A circle having a diameter of 508 mm was punched out of the multilayer body, and a through hole having a length of 4.8% of the radius (12 mm) and a width of 9.4% of the radius (24 mm) was created in a location where the end of the through hole closer to the center of the polishing pad was at a distance of 46.5% of the radius (118 mm) from the center of the polishing pad using a punching machine. The form of the gained structure is shown in FIGS. 3 and 4. The end of the through hole closer to the center of the polishing pad was in a location at a distance of 46.5% of the radius from the center of the polishing pad. XY-grooves in lattice form having a width of 1 mm, a depth of 0.825 mm and a pitch of 20 mm were created on the surface of the polishing layer of the above described polishing pad by means of an NC rooter and, thus, a polishing pad was gained.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 23.5 and the minimum being 20.0, and it was possible to sense the final point. The polishing rate of the oxide film was 2500 angstroms/min. The uniformity within the plane was as excellent as 12%.

When scratches of 0.18 μm or greater were observed on the polished wafer using a defect inspecting apparatus, trade name: "SP-1," made by KLA-Tencol Co., Ltd., the number of scratches was four, which was excellent.

Subsequently, polishing was carried out for nine hours, and then, a change in the intensity due to the interference by the laser beam was clearly observed together with a change in the film thickness, and a sufficiently large change in the intensity was maintained with the maximum being 23.5 and the minimum being 20.0, and it was possible to detect the final point. The polishing rate of the oxide film was 2400 angstroms/min. The uniformity within the plane was as excellent as 13%.

When scratches of 0.18 μm or greater were observed on the polished wafer using a defect inspecting apparatus, trade name: "SP-1," made by KLA-Tencol Co., Ltd., the number of scratches was six, which was excellent.

Example 2

30 weight parts of polypropylene glycol, 40 weight parts of diphenylmethane diisocyanate, 0.5 weight parts of water, 0.4 weight parts of triethylamine, 1.8 weight parts of a silicone foaming agent and 0.09 weight parts of tin octylate were mixed in an RIM molding machine, and the mixture was discharged into a mold for pressure molding and, thus, a foam polyurethane sheet having a thickness of 2.2 mm (micro-rubber A hardness: 23, density: 0.47 g/cm$^3$, average bubble diameter of isolated bubbles: 72 μm) was fabricated.

The above described foam polyurethane sheet was immersed in methyl methacrylate to which 0.1 weight parts of azobisisobutylonitrile was added for 10 minutes. The foam polyurethane sheet where methyl methacrylate swelled was sandwiched between glass plates and heated for 6 hours at 65° C. and, after that, heated for three hours at 100° C. After heating, the foam polyurethane sheet was taken out from the glass plates and vacuum dried at 50° C.

The two sides of the thus gained hard foam sheet were polished, and a polishing layer having a thickness of 2.00 mm was fabricated. The content of polymethyl methacrylate in the polishing layer was 65 weight %. In addition, the micro-rubber A hardness of the polishing layer was 87 degrees, the density was 0.50 g/cm$^3$ and the average diameter of the isolated bubbles was 109 μm.

A groove with a width of 2 mm and a depth of 1 mm was created in advance in thermoplastic polyurethane, made by Nihon Matai Co., Ltd., having a micro-rubber A hardness of 75 degrees and a thickness of 2.0 mm (volume modulus of elasticity: 100 MPa, tensile modulus of elasticity: 7 MPa) using an NC rooter with a round blade having a width of 2 mm and, thus, a cushion layer was gained and pasted onto the polishing layer with an adhesive layer (middle tape) 550 D, made by Sekisui Chemical Co., Ltd., in between so that a multilayer body was fabricated and, furthermore, a double-sided tape 5604 TDX, made by Sekisui Chemical Co., Ltd., was pasted to the rear surface as a rear surface tape.

A circle having a diameter of 508 mm was punched out from this multilayer body, and a through hole with a length being 4.8% of the radius (12 mm) and a width being 9.4% of the radius (24 mm) was created in such a location that the end of the through hole closer to the center of the polishing pad was at a distance of 46.5% of the radius (118 mm) from the center of the polishing pad using a punching machine. The form of the thus gained structure is shown in FIGS. 5 and 6. The end of the through hole close to the center of the polishing pad was located at a distance of 46.5% of the radius from the center of the polishing pad. XY-grooves in lattice form with a width of 1 mm, a depth of 0.6 mm and a pitch of 30 mm were created on the surface of the polishing layer of the above described polishing pad using an NC rooter and, thus, a polishing pad was gained.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 23.6 and the minimum being 20.2, and it was possible to sense the final point. The polishing rate of the oxide film was 2600 angstroms/min. The uniformity within the plane was as excellent as 9%.

When scratches of 0.18 μm or greater were observed on the polished wafer using a defect inspecting apparatus, trade name: "SP-1," made by KLA-Tencol Co., Ltd., the number of scratches was two, which was excellent.

Subsequently, polishing was carried out for nine hours, and then, a change in the intensity due to the interference by the laser beam was clearly observed together with a change in the film thickness, and a sufficiently large change in the intensity was maintained with the maximum being 23.7 and the minimum being 20.1, and it was possible to detect the final point. The polishing rate of the oxide film was 2650 angstroms/min. The uniformity within the plane was as excellent as 8%.

When scratches of 0.18 μm or greater were observed on the polished wafer using a defect inspecting apparatus, trade name: "SP-1," made by KLA-Tencol Co., Ltd., the number of scratches was three, which was excellent.

Example 3

A multilayer body was fabricated in accordance with the same method as in Example 1.

A circle having a diameter of 508 mm was punched out from this multilayer body, and a through hole with a length being 4.8% of the radius (12 mm) and a width being 9.4% of the radius (24 mm) was created in such a location that the end of the through hole closer to the center of the polishing pad was at a distance of 37.8% of the radius (96 mm) from the center of the polishing pad using a punching machine. The end of the through hole closer to the center of the polishing pad was located at a distance of 37.8% of the radius from the center of the polishing pad. XY-grooves in lattice form with a width of 1 mm, a depth of 0.6 mm and a pitch of 30 mm were created on the surface of the polishing layer of the above described polishing pad using an NC rooter, and thus, a polishing pad was gained.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 22.6 and the minimum being 19.2, and it was possible to sense the final point. The polishing rate of the oxide film was 2600 angstroms/min. The uniformity within the plane was as excellent as 9%.

When scratches of 0.18 μm or greater were observed on the polished wafer using a defect inspecting apparatus, trade name: "SP-1," made by KLA-Tencol Co., Ltd., the number of scratches was three, which was excellent.

Subsequently, polishing was carried out for nine hours, and then, a change in the intensity due to the interference by the laser beam was clearly observed together with a change in the film thickness, and a sufficiently large change in the intensity was maintained with the maximum being 22.7 and the minimum being 19.1, and it was possible to detect the final point. The polishing rate of the oxide film was 2650 angstroms/min. The uniformity within the plane was as excellent as 8%.

When scratches of 0.18 μm or greater were observed on the polished wafer using a defect inspecting apparatus, trade name: "SP-1," made by KLA-Tencol Co., Ltd., the number of scratches was five, which was excellent.

Example 4

A multilayer body was fabricated in accordance with the same method as in Example 1.

A circle having a diameter of 775 mm was punched out from this multilayer body, and a through hole with a length being 3.01% of the radius (12 mm) and a width being 4.90% of the radius (19 mm) was created in such a location that the end of the through hole closer to the center of the polishing pad was at a distance of 49.2% of the radius (191 mm) from the center of the polishing pad using a punching machine. The end of the through hole closer to the center of the polishing pad was located at a distance of 49.2% of the radius from the center of the polishing pad. XY-grooves in lattice form with a width of 1 mm, a depth of 0.825 mm and a pitch of 20 mm were created on the surface of the polishing layer of the above described polishing pad using an NC rooter and, thus, a polishing pad was gained.

A protective film where an adhesive material was applied onto a polyester film was pasted to a transparent material, through which a laser beam transmitted, and which was attached to the platen of a polishing machine (registered trademark "Reflexion," made by Applied Materials, Inc.) with a function of sensing the final point so that no slurry could make contact with the transparent material. The above described polishing pad was pasted to the thus gained platen in such a manner that the through hole coincided with the transparent material of the platen. A 12-inch wafer with an oxide film was polished under a retainer ring pressure of 10.4 psi, Z1 of 8 psi, Z2 of 4.4 psi, Z3 of 4 psi, a number of rotations of platen of 51 rpm and a number of rotations of the polishing head of 49 rpm, and with slurry (SS-12, made by Cabot Corporation) flowing at a flowing rate of 150 cc/min when a change in the intensity as a result of interference by a laser beam accompanying a change in the film thickness was clearly observed, and there was a sufficiently large change in the intensity with the maximum being 20.6 and the minimum being 18.2, and it was possible to sense the final point. The polishing rate of the oxide film was 2300 angstroms/min. The uniformity within the plane was as excellent as 10%.

When scratches of 0.18 μm or greater were observed on the polished wafer using a defect inspecting apparatus, trade name: "Complus," made by Applied Materials, Inc., the number of scratches was five, which was excellent.

Subsequently, polishing was carried out for nine hours and, then, a change in the intensity due to the interference by the laser beam was clearly observed together with a change in the film thickness, and a sufficiently large change in the intensity was maintained with the maximum being 20.5 and the minimum being 18.3, and it was possible to detect the final point. The polishing rate of the oxide film was 2450 angstroms/min. The uniformity within the plane was as excellent as 9%.

When scratches of 0.18 μm or greater were observed on the polished wafer using a defect inspecting apparatus, trade name: "Complus," made by Applied Materials, Inc., the number of scratches was six, which was excellent.

Example 5

A multilayer body was fabricated in accordance with the same method as in Example 1.

A circle having a diameter of 508 mm was punched out from this multilayer body, and a through hole with a length being 7.4% of the radius (19 mm) and a width being 9.4% of the radius (24 mm) was created in such a location that the end of the through hole closer to the center of the polishing pad was at a distance of 54.3% of the radius (138 mm) from the center of the polishing pad using a punching machine. The end of the through hole closer to the center of the polishing pad was located at a distance of 54.3% of the radius from the center of the polishing pad. XY-grooves in lattice form with a width of 1 mm, a depth of 0.6 mm and a pitch of 30 mm were created on the surface of the polishing layer of the above described polishing pad using an NC rooter and, thus, a polishing pad was gained.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 19.6 and the minimum being 17.2, and it was possible to sense the final point. The polishing rate of the oxide film was 2400 angstroms/min. The uniformity within the plane was as excellent as 11%.

When scratches of 0.18 μm or greater were observed on the polished wafer using a defect inspecting apparatus, trade name: "SP-1," made by KLA-Tencol Co., Ltd., the number of scratches was four, which was excellent.

Subsequently, polishing was carried out for nine hours, and then, a change in the intensity due to the interference by the laser beam was clearly observed together with a change in the film thickness, and a sufficiently large change in the intensity was maintained with the maximum being 19.7 and the minimum being 17.3, and it was possible to detect the final point. The polishing rate of the oxide film was 2430 angstroms/min. The uniformity within the plane was as excellent as 10%.

When scratches of 0.18 μm or greater were observed on the polished wafer using a defect inspecting apparatus, trade name: "SP-1," made by KLA-Tencol Co., Ltd., the number of scratches was four, which was excellent.

Example 6

A multilayer body was fabricated in accordance with the same method as in Example 1.

A circle having a diameter of 508 mm was punched out from this multilayer body, and a through hole with a length being 4.8% of the radius (12 mm) and a width being 4.8% of the radius (12 mm) was created in such a location that the end of the through hole closer to the center of the polishing pad was at a distance of 35.4% of the radius (90 mm) from the center of the polishing pad using a punching machine. The end of the through hole closer to the center of the polishing pad was located at a distance of 35.4% of the radius from the center of the polishing pad. XY-grooves in lattice form with a width of 1 mm, a depth of 0.6 mm and a pitch of 30 mm were created on the surface of the polishing layer of the above described polishing pad using an NC rooter and, thus, a polishing pad was gained.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure, of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 20.6 and the minimum being 18.3, and it was possible to sense the final point. The polishing rate of the oxide film was 2550 angstroms/min. The uniformity within the plane was as excellent as 9%.

When scratches of 0.18 μm or greater were observed on the polished wafer using a defect inspecting apparatus, trade name: "SP-1," made by KLA-Tencol Co., Ltd., the number of scratches was three, which was excellent.

Subsequently, polishing was carried out for nine hours, and then, a change in the intensity due to the interference by the laser beam was clearly observed together with a change in the film thickness, and a sufficiently large change in the intensity was maintained with the maximum being 20.7 and the minimum being 18.5, and it was possible to detect the final point. The polishing rate of the oxide film was 2430 angstroms/min. The uniformity within the plane was as excellent as 8%.

When scratches of 0.18 μm or greater were observed on the polished wafer using a defect inspecting apparatus, trade name: "SP-1," made by KLA-Tencol Co., Ltd., the number of scratches was six, which was excellent.

Comparative Example 1

An opening with a length of 12 mm and a width of 24 mm was created in IC-1000 (made by Nitta Haas Company) (density: 0.82 g/cm$^3$, average bubble diameter: 23 μm) (thickness: 1.25 mm, size: diameter: 508 mm), which is a commercially available micro-balloon containing foam polyurethane, instead of the polishing layer of Example 1 in such a location that the end of the opening closest to the center of the polishing pad was at a distance of 118 mm from the center of the polishing pad. An opening which was slightly smaller than the opening that was created in the above described IC-1000 was created in the polyethylene foam, of which the volume had quadrupled through foaming, having a thickness of 0.8 mm, made by Toray Industries, Inc., on which a discharging process was carried out to increase the adhesiveness (percentage of water absorption: 0.5%), and IC-1000 and the polyethylene foam were pasted together using a double-sided tape 442J, made by Sumitomo 3M Co., Ltd., as the middle tape. Double-sided tape 5604 TDX, made by Sekisui Chemical Co., Ltd., was pasted as the rear surface tape. A window member, which had been prepared in advance, made of hard polyurethane (hardness: micro-rubber A hardness: 99 degrees) having the same size as the opening of the above described IC-1000 and a thickness of 1.25 mm was fit into the opening in the polishing layer of the above described polishing pad.

XY-grooves in lattice form having a width of 1 mm, a depth of 0.6 mm and a pitch of 20 mm were created on the surface of the polishing layer of the above described polishing pad using an NC rooter and, thus, a polishing pad for detecting the final point was gained.

The above described polishing pad was pasted to the transparent material through which a laser beam transmitted and which was attached to the platen of the polishing machine with a function of sensing the final point (registered trademark "MIRRA 3400," made by Applied Materials, Inc.) in such a manner that the window member coincided with the hole. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 23.0 and the minimum being 21.0, and it was possible to sense the final point. The polishing rate of the oxide film was 2450 angstroms/min. The uniformity within the plane was as excellent as 12%.

When scratches of 0.18 μm or greater were observed on the polished wafer using a defect inspecting apparatus, trade name: "SP-1," made by KLA-Tencol Co., Ltd., the number of scratches was 45, which was poor.

Subsequently, polishing was carried out for nine hours, and then, a change in the intensity due to the interference by the laser beam was lowered together with a change in the film thickness, and it was difficult to detect the final point with high precision with the maximum being 22.1 and the minimum being 21.1. The polishing rate of the oxide film was 2300 angstroms/min. The uniformity within the plane was 15%, which was a little worse.

When scratches of 0.18 μm or greater were observed on the polished wafer using a defect inspecting apparatus, trade name: "SP-1," made by KLA-Tencol Co., Ltd., the number of scratches was 90, which was poor.

Comparative Example 2

A through hole with a length of 22.8% of the radius (58 mm) and a width of 7.4% of the radius (19 mm) was created in the same multilayer polishing pad as in Example 1 in such a location that the end of the through hole closer to the center of the polishing pad was at a distance of 29% of the radius (74 mm) from the center of the polishing pad using a punching machine. The end of the through hole closer to the center of the polishing pad was located at a distance of 29% of the radius from the center of the polishing pad.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min, and there was a small change in the intensity as a result of interference by a laser beam accompanying a change in the film thickness with the maximum being 21.5 and the minimum being 20.0 and, thus, the change in the strength was small and it was difficult to detect the final point. The polishing rate of the oxide film was 2800 angstroms/min. The uniformity within the plane was as excellent as 7%.

When scratches of 0.18 μm or greater were observed on the polished wafer using a defect inspecting apparatus, trade name: "SP-1," made by KLA-Tencol Co., Ltd., the number of scratches was 10, which was excellent.

Subsequently, polishing was carried out for nine hours, and then, the maximum of the change in the intensity due to the interference by a laser beam together with the change in the film thickness was 21.5 and the minimum was 20.0, and thus, the change in the strength was small and it was difficult to detect the final point. The polishing rate of the oxide film was 2750 angstroms/min. The uniformity within the plane was as excellent as 6%.

When scratches of 0.18 μm or greater were observed on the polished wafer using a defect inspecting apparatus, trade name: "SP-1," made by KLA-Tencol Co., Ltd., the number of scratches was 30, which was poor.

Comparative Example 3

A through hole with a length of 4.8% of the radius (12 mm) and a width of 19.6% of the radius (50 mm) was created in the same multilayer polishing pad as in Example 1 in such a location that the end of the through hole closer to the center of the polishing pad was at a distance of 46.5% of the radius (118 mm) from the center of the polishing pad using a punching machine. The end of the through hole closer to the center of the polishing pad was located at a distance of 46.5% of the radius from the center of the polishing pad.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 23.6 and the minimum being 20.2, and it was possible to sense the final point. The polishing rate of the oxide film was 2500 angstroms/min, but the uniformity within the plane was 25%, which was poor.

When scratches of 0.18 μm or greater were observed on the polished wafer using a defect inspecting apparatus, trade name: "SP-1," made by KLA-Tencol Co., Ltd., the number of scratches was two, which was excellent.

Subsequently, polishing was carried out for nine hours and, then, a change in the intensity due to the interference by the laser beam was clearly observed together with a change in the film thickness, and a sufficiently large change in the intensity was maintained with the maximum being 23.7 and the minimum being 20.1, and it was possible to detect the final point. The polishing rate of the oxide film was 2400 angstroms/min. The uniformity within the plane was 30%, which was poor.

When scratches of 0.18 μm or greater were observed on the polished wafer using a defect inspecting apparatus, trade name: "SP-1," made by KLA-Tencol Co., Ltd., the number of scratches was 1.0, which was excellent.

Comparative Example 4

A through hole with a length of 4.8% of the radius (12 mm) and a width of 9.4% of the radius (24 mm) was created in the same multilayer polishing pad as in Example 1 in such a location that the end of the through hole closer to the center of the polishing pad was at a distance of 29.1% of the radius (73.9 mm) from the center of the polishing pad using a punching machine. The end of the through hole closer to the center of the polishing pad was located at a distance of 29.1% of the radius from the center of the polishing pad.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min, and there was a small change in the intensity as a result of interference by a laser beam accompanying a change in the film thickness with the maximum being 21.5 and the minimum being 20.0, and it was difficult to detect the final point. The polishing rate of the oxide film was 2400 angstroms/min. The uniformity within the plane was as excellent as 8%.

When scratches of 0.18 μm or greater were observed on the polished wafer using a defect inspecting apparatus, trade name: "SP-1," made by KLA-Tencol Co., Ltd., the number of scratches was two, which was excellent.

Comparative Example 5

A through hole with a length of 9.4% of the radius (24 mm) and a width of 7.4% of the radius (19 mm) was created in the same multilayer polishing pad as in Example 1 in such a location that the end of the through hole closer to the center of the polishing pad was at a distance of 46.5% of the radius (118 mm) from the center of the polishing pad using a punching machine. The end of the through hole closer to the center of the polishing pad was located at a distance of 46.5% of the radius from the center of the polishing pad.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when a change in the intensity as a result of interference by a laser beam accompanying a change in the film thickness was clearly observed, and there was a sufficiently large change in the intensity with the maximum being 23.6 and the minimum being 20.2 and, thus, there was a sufficiently significant change in the strength and it was possible to sense the final point. The polishing rate of the oxide film was 2400 angstroms/min, but the uniformity within the plane was 20%, which was poor.

When scratches of 0.18 μm or greater were observed on the polished wafer using a defect inspecting apparatus, trade name: "SP-1," made by KLA-Tencol Co., Ltd., the number of scratches was two, which was excellent.

Comparative Example 6

A through hole with a length of 22.8% of the radius (58 mm) and a width of 7.4% of the radius (19 mm) was created in the same multilayer polishing pad as in Example 1 in such a location that the end of the through hole closer to the center of the polishing pad was at a distance of 46.5% of the radius (118 mm) from the center of the polishing pad using a punching machine. The end of the through hole closer to the center of the polishing pad was located at a distance of 46.5% of the radius from the center of the polishing pad.

A protective film where an adhesive material was applied onto a polyester film was pasted to a transparent material, through which a laser beam transmitted, and which was attached to the platen of a polishing machine (registered trademark "MIRRA 3400," made by Applied Materials, Inc.) with a function of sensing the final point so that no slurry could make contact with the transparent material. The above described polishing pad was pasted to the thus gained platen in such a manner that the through hole coincided with the transparent material of the platen. An 8-inch wafer with an oxide film was polished under a retainer ring pressure of 8 psi, an inner tube pressure of 5 psi, a membrane pressure of 7 psi, a number of rotations of platen of 45 rpm and a number of rotations of the polishing head of 45 rpm, and with slurry (SS-12, made by Cabot Corporation) flowing at a flowing rate of 200 cc/min when the maximum in the change in the intensity as a result of interference by a laser beam accompanying a change in the film thickness was 21.5 and the minimum was 20.0, and thus, the change in the strength was small and it was difficult to detect the final point. The polishing rate of the oxide film was 2450 angstroms/min, but the uniformity within the plane was 25%, which was poor.

When scratches of 0.18 μm or greater were observed on the polished wafer using a defect inspecting apparatus, trade name: "SP-1," made by KLA-Tencol Co., Ltd., the number of scratches was two, which was excellent.

Comparative Example 7

A through hole with a length of 4.9% of the radius (19 mm) and a width of 6.2% of the radius (24 mm) was created in the same multilayer polishing pad as in Example 4 in such a location that the end of the through hole closer to the center of the polishing pad was at a distance of 29.1% of the radius (113 mm) from the center of the polishing pad using a punching machine. The end of the through hole closer to the center of the polishing pad was located at a distance of 29.1% of the radius from the center of the polishing pad.

A protective film where an adhesive material was applied onto a polyester film was pasted to a transparent material, through which a laser beam transmitted, and which was attached to the platen of a polishing machine (registered trademark "Reflexion," made by Applied Materials, Inc.) with a function of sensing the final point so that no slurry could make contact with the transparent material. The above described polishing pad was pasted to the thus gained platen in such a manner that the through hole coincided with the transparent material of the platen. A 12-inch wafer with an oxide film was polished under a retainer ring pressure of 10.4 psi, Z1 of 8 psi, Z2 of 4.4 psi, Z3 of 4 psi, a number of rotations of platen of 51 rpm and a number of rotations of the polishing head of 49 rpm, and with slurry (SS-12, made by Cabot Corporation) flowing at a flowing rate of 150 cc/min when the maximum in the change in the intensity as a result of interference by a laser beam accompanying a change in the film thickness was 21.5 and the minimum was 20.1, and thus, the change in the strength was small and it was difficult to detect the final point. The polishing rate of the oxide film was 2320 angstroms/min. The uniformity within the plane was 10%, which was excellent.

When scratches of 0.18 μm or greater were observed-on the polished wafer using a defect inspecting apparatus, trade name: "Complus," made by Applied Materials, Inc., the number of scratches was five, which was excellent.

Comparative Example 8

A through hole with a length of 15.0% of the radius (58 mm) and a width of 6.2% of the radius (24 mm) was created in the same multilayer polishing pad as in Example 4 in such a location that the end of the through hole closer to the center of the polishing pad was at a distance of 46.5% of the radius (180 mm) from the center of the polishing pad using a punching machine. The end of the through hole closer to the center of the polishing pad was located at a distance of 46.5% of the radius from the center of the polishing pad.

A protective film where an adhesive material was applied onto a polyester film was pasted to a transparent material, through which a laser beam transmitted, and which was attached to the platen of a polishing machine (registered trademark "Reflexion," made by Applied Materials, Inc.) with a function of sensing the final point so that no slurry could make contact with the transparent material. The above described polishing pad was pasted to the thus gained platen in such a manner that the through hole coincided with the transparent material of the platen. A 12-inch wafer with an oxide film was polished under a retainer ring pressure of 10.4 psi, Z1 of 8 psi, Z2 of 4.4 psi, Z3 of 4 psi, a number of rotations of platen of 51 rpm and a number of rotations of the polishing head of 49 rpm, and with slurry (SS-12, made by Cabot Corporation) flowing at a flowing rate of 150 cc/min when the maximum in the change in the intensity as a result of interference by a laser beam accompanying a change in the film thickness was 21.5 and the minimum was 20.2 and, thus, the change in the strength was small and it was difficult to detect the final point. The polishing rate of the oxide film was 2250 angstroms/min. The uniformity within the plane was 24%, which was poor.

When scratches of 0.18 μm or greater were observed on the polished wafer using a defect inspecting apparatus, trade name: "Complus," made by Applied Materials, Inc., the number of scratches was five, which was excellent.

Comparative Example 9

A through hole with a length of 15.0% of the radius (58 mm) and a width of 6.2% of the radius (24 mm) was created in the same multilayer polishing pad as in Example 4 in such a location that the end of the through hole closer to the center of the polishing pad was at a distance of 46.5% of the radius (180 mm) from the center of the polishing pad using a punching machine. The end of the through hole closer to the center of the polishing pad was located at a distance of 46.5% of the radius from the center of the polishing pad.

When scratches of 0.18 μm or greater were observed on the polished wafer using a defect inspecting apparatus, trade name: "Complus," made by Applied Materials, Inc., the number of scratches was five, which was excellent.

The results for Examples 1 to 6 and Comparative Examples 1 to 9 are shown in Table: 1. As for the detection of the final point, A was given if it was possible, B was given if was slightly possible, and C was given if it was impossible. As for the uniformity within the plane, A was given if it was excellent both initially and nine hours later, B was given if it was excellent initially but tended to be worse nine hours later, and C was given if it was poor both initially and nine hours later. As for scratching, A was given if there were a few scratches, B was given if there were some scratches, and C was given if there were many scratches.

TABLE 1

| Direction of center of through hole | Ratio of distance between center of polishing pad and end of through hole closer to center of polishing pad to radius (%) | Ratio of length of through hole in direction of center of polishing pad to radius (length) (% (mm)) | Ratio of length of through hole in direction perpendicular to direction of center of polishing pad to radius (length) (% (mm)) | Detection of final point | Uniformity within plane | Scratching |
|---|---|---|---|---|---|---|
| Example 1 | 46.5 | 4.8(12) | 9.4(24) | A | A | A |
| Example 2 | 46.5 | 4.8(12) | 9.4(24) | A | A | A |
| Comparative Example 1 | 46.5 | 4.8(12) | 9.4(24) | A | B | C |
| Comparative Example 2 | 29.1 | 22.8(58) | 7.4(19) | C | A | C |
| Comparative Example 3 | 46.5 | 4.8(12) | 19.6(50) | A | C | A |
| Example 3 | 37.8 | 4.8(12) | 9.4(24) | A | A | A |
| Example 4 | 49.2 | 3.01(12) | 4.9(19) | A | A | A |
| Example 5 | 54.3 | 7.4(19) | 9.4(24) | A | A | A |
| Example 6 | 35.4 | 4.8(12) | 4.8(12) | A | A | A |
| Comparative Example 4 | 29.1 | 4.8(12) | 9.4(24) | C | A | A |
| Comparative Example 5 | 46.5 | 9.4(24) | 7.4(19) | A | C | A |
| Comparative Example 6 | 46.5 | 22.8(58) | 7.4(19) | C | C | A |
| Comparative Example 7 | 29.1 | 4.9(19) | 6.2(24) | C | A | A |
| Comparative Example 8 | 46.5 | 15.0(58) | 6.2(24) | C | A | A |
| Comparative Example 9 | 46.5 | 6.2(24) | 12.9(50) | A | C | A |

A protective film where an adhesive material was applied onto a polyester film was pasted to a transparent material, through which a laser beam transmitted, and which was attached to the platen of a polishing machine (registered trademark "Reflexion," made by Applied Materials, Inc.) with a function of sensing the final point so that no slurry could make contact with the transparent material. The above described polishing pad was pasted to the thus gained platen in such a manner that the through hole coincided with the transparent material of the platen. A 12-inch wafer with an oxide film was polished under a retainer ring pressure of 10.4 psi, Z1 of 8 psi, Z2 of 4.4 psi, Z3 of 4 psi, a number of rotations of platen of 51 rpm and a number of rotations of the polishing bead of 49 rpm, and with slurry (SS-12, made by Cabot Corporation) flowing at a flowing rate of 150 cc/min when a change in the intensity as a result of interference by a laser beam accompanying a change in the film thickness was clearly observed with the maximum being 23.6 and the minimum being 20.2 and, thus, there was a sufficiently significant change in the strength and it was possible to detect the final point. The polishing rate of the oxide film was 2230 angstroms/min. The uniformity within the plane was 21%, which was poor.

The invention claimed is:

1. A polishing pad comprising a polishing surface, a rear surface and a through hole that connects the polishing and rear surfaces together, wherein an end of the through hole closer to the center of the polishing pad is at a distance of no less than 35% of the radius from the center of the polishing pad, the length of the through hole in the direction of the center of the polishing pad is the same as or shorter than the length of the through hole in a direction perpendicular to the direction of the center of the polishing pad, the length of the through hole in the direction of the center' of the polishing pad is no more than 10% of the radius, and the length of the through hole in a direction perpendicular to the direction of the center of the polishing pad is no, more than 12.5% of the radius.

2. The polishing pad according to claim 1, further comprising a path that connects the through hole and a side of the polishing pad.

3. The polishing pad according to claim 1, further comprising a cushion layer with a ratio of water absorption of no more than 5%.

4. The polishing pad according to claim 3, wherein the cushion layer is an un-foamed elastomer layer.

5. The polishing pad according to claim 1, further comprising a groove in the polishing surface, and the groove does not make contact with the through hole in a region inside a, concentric circle on the polishing pad that passes through the center of the through hole.

6. A polishing apparatus comprising the polishing pad according to claim 1, a means for moving said polishing pad and a substrate relative to each other while making the polishing pad and the substrate contact each other so that the substrate is polished, a means for supplying a slurry between said polishing pad and a workpiece, and a means for optically measuring the status of polishing through a polishing layer of said polishing pad.

7. A protective film for the polishing apparatus according to claim 6, which has a platen for securing the polishing pad, where the platen has a hole for optically measuring the status of polishing and a transparent material fitted into the hole, the protective film comprising three layers: a base film, an adhesive layer and a separator film, so that the separator film on top of the adhesive layer is larger than the base film and protrudes from an end of the base film, and is divided into two or more pieces.

8. A method for polishing an insulating film or a metal wire with the polishing pad according to claim 1 comprising: contacting the polishing pad with the insulating film or the metal wire and optically measuring the status of polishing.

* * * * *